US012791014B2

(12) United States Patent
Hansson et al.

(10) Patent No.: US 12,791,014 B2
(45) Date of Patent: Nov. 10, 2026

(54) PUMPING ASSEMBLY

(71) Applicant: GDS Geo Drilling Solutions AB, Saltsjö-Boo (SE)

(72) Inventors: Robert Hansson, Värmdö (SE); Hans Eklund, Grisslehamn (SE)

(73) Assignee: GDS Geo Drilling Solutions AB, Saltsjo-Boö (SE)

( * ) Notice: Subject to any disclaimer, the term of this patent is extended or adjusted under 35 U.S.C. 154(b) by 0 days.

(21) Appl. No.: 19/064,313

(22) Filed: Feb. 26, 2025

(65) Prior Publication Data

US 2025/0270887 A1 Aug. 28, 2025

(30) Foreign Application Priority Data

Feb. 27, 2024 (SE) ..... 2450232-0

(51) Int. Cl.
*F04B 23/04* (2006.01)
*E21B 21/08* (2006.01)
(Continued)

(52) U.S. Cl.
CPC ..... *F04B 23/04* (2013.01); *E21B 21/08* (2013.01); *F04B 15/02* (2013.01); *F04B 17/03* (2013.01);
(Continued)

(58) Field of Classification Search
CPC ..... F04B 17/03; F04B 23/04; F04B 23/06; F04B 49/00; F04B 49/06; F04B 49/065; F04B 49/08; F04B 49/20; F04B 47/00; F04B 15/02; E21B 21/00; E21B 21/08; E21B 4/14
See application file for complete search history.

(56) References Cited

U.S. PATENT DOCUMENTS 5,064,005 A * 11/1991 Krone ..... B25D 9/12 91/170 R
9,115,705 B2 8/2015 Best
(Continued)

FOREIGN PATENT DOCUMENTS

CN 2556411 Y 6/2003
CN 213572163 U 6/2021
(Continued)

OTHER PUBLICATIONS

European Search Report on EP 25159317.4 Dtd May 21, 2025.
(Continued)

*Primary Examiner* — Essama Omgba
*Assistant Examiner* — Chirag Jariwala
(74) *Attorney, Agent, or Firm* — Foley & Lardner LLP

(57) ABSTRACT

A pumping assembly for providing pressurized liquid to a liquid propelled drill or hammer is provided. The pumping assembly includes at least two pump modules, each including at least one liquid pump, at least one electric motor arranged to drive said at least one liquid pump, and a liquid outlet for providing pressurized liquid from the at least one liquid pump, and an outlet manifold connecting the liquid outlets of the at least two pump modules in parallel to provide a common liquid outlet for connection to said liquid propelled drill or hammer. The pump modules are each configured to provide a liquid flow of 200-600 l/min.

11 Claims, 1 Drawing Sheet

(51) Int. Cl.

| | |
|---|---|
| ***F04B 15/02*** | (2006.01) |
| ***F04B 17/03*** | (2006.01) |
| ***F04B 47/00*** | (2006.01) |
| ***F04B 49/06*** | (2006.01) |
| ***F04B 49/08*** | (2006.01) |
| ***F04B 49/20*** | (2006.01) |
| *E21B 4/14* | (2006.01) |

(52) U.S. Cl.
CPC ..... *F04B 47/00* (2013.01); *F04B 49/065* (2013.01); *F04B 49/08* (2013.01); *F04B 49/20* (2013.01); *E21B 4/14* (2013.01)

(56) References Cited

U.S. PATENT DOCUMENTS

| | | | | |
|---|---|---|---|---|
| 11,018,610 | B2 * | 5/2021 | Chedygov | H02K 9/18 |
| 11,448,050 | B1 * | 9/2022 | Newman | F04B 49/02 |
| 2014/0209703 | A1 | 7/2014 | Jerdee et al. | |
| 2020/0072201 | A1 | 3/2020 | Marica | |
| 2020/0165873 | A1 | 5/2020 | Scott | |
| 2020/0284122 | A1 * | 9/2020 | Golden | G05D 16/2033 |
| 2021/0140295 | A1 | 5/2021 | Coli et al. | |
| 2023/0258049 | A1 | 8/2023 | Olson et al. | |
| 2024/0019057 | A1 | 1/2024 | Oehring et al. | |
| 2025/0180006 | A1 * | 6/2025 | Sun | F04B 23/04 |
| 2025/0207528 | A1 * | 6/2025 | Chowdhury | F02B 63/06 |

FOREIGN PATENT DOCUMENTS

| | | | |
|---|---|---|---|
| DE | 10 2011 013 112 | A1 | 9/2012 |
| DE | 10 2018 106 496 | A1 | 9/2019 |
| DE | 11 2021 000 001 | T5 | 12/2021 |
| EP | 2 025 934 | A1 | 2/2009 |
| EP | 4 056 847 | A1 | 9/2022 |
| SE | 544129 | C2 | 1/2022 |
| WO | WO-2012/067808 | A1 | 5/2012 |

OTHER PUBLICATIONS

First Notice/Search report on SE 2450232-0 Dtd Jul. 9, 2024.
Geo Drilling Solutions. "High Pressure Water Pump GDS 850 Twin". May 18, 2021. PDF. 4 pages.
Communication pursuant to Article 94(3) EPC on EP 25159317.4 DTD Jun. 17, 2026.

* cited by examiner

PUMPING ASSEMBLY

CROSS-REFERENCE TO RELATED APPLICATION

The present Application claims the benefit of and priority to Swedish Application No. 2450232-0, filed Feb. 27, 2024, which is incorporated herein by reference in its entirety.

TECHNICAL FIELD

The invention relates to the field of pumps for providing pressurized liquid to a liquid propelled drill or hammer.

BACKGROUND

Pumps for providing pressurized liquid to liquid propelled/liquid powered drills/hammers such as liquid water powered down the hole (DTH) hammers. Although liquid powered/propelled drills/hammers normally use water as powering/propelling liquid, it is understood that other types of liquids which comprises water and other constituents may also be used. One example of such a liquid is mud.

Liquid propelled drills/hammers are available in different sizes which require different liquid flows from the high-pressure pump arrangement. To some extent, this can be handled by controlling the pump arrangement, e.g. by controlling the pump speed, but there is still a need for pump arrangements with different capacities. Manufacturing and distributing different sizes of the high-pressure pumps is costly and time-consuming, however.

The applicant's current product line includes the GDS 850 Twin which comprises a diesel engine driving two pumps, where the engine and the pumps are mounted in a common enclosure. The two pumps pump can be connected in parallel such as to supply a single large liquid hammer (6" or 8") or can be connected individually to supply one or two small to medium size (2" to 5") hammers. This allows the GDS 850 Twin to handle most requirements at working sites. One disadvantage is that the efficiency is less than optimal when operating only one small to medium size hammer. Another disadvantage is that the enclosure is quite large and heavy due to the overall weight and size of the two pumps and the diesel engine.

SUMMARY

An object of the invention is to provide a pumping assembly which solves or at least improves on one or more of the problems mentioned in the background section.

These and other objects are achieved by the present invention by means of a pumping assembly according to the independent claim.

According to a first aspect of the invention, there is provided a pumping assembly for providing pressurized liquid to a liquid propelled drill or hammer, the pumping assembly comprising at least two pump modules and an outlet manifold. Each pump module comprises at least one liquid pump, at least one electric motor arranged to drive said at least one liquid pump, and a liquid outlet for providing pressurized liquid from the at least one liquid pump. The outlet manifold connects the liquid outlets of the at least two pump modules in parallel to provide a common liquid outlet for connection to the liquid propelled drill. The term outlet manifold is to be interpreted broadly as any type of element or device connecting the liquid outlets together into a common liquid outlet. The liquid may be water.

Each pump module normally only comprises one liquid pump driven by one electric motor, but it is foreseeable within the scope of the invention that the individual pump modules each comprise two or more liquid pumps driven by at least one (such as two or more) electric motors. In embodiments where the pump module comprises two or more liquid pumps, their outlets are connected in parallel to the (common) liquid outlet. It is understood that each pump module is fitted in its own enclosure/chassis, i.e. the pump modules can be operated and transported individually. The pump modules may be configured to provide a maximum liquid pressure of 120-240 bar. The pump modules may each be configured to provide a liquid flow of 200-600 l/min.

The invention is based on the insight that by making the pumping assembly modular, i.e. comprising two or more completely independent (physically separate) pump modules, a highly versatile system is achieved where any capacity requirement at a working site can be met by using a corresponding number of pump modules. Using two or more smaller pump modules rather than one larger module also means that transportation is simplified. The invention is further based on the insight that using an electric motor rather than a diesel engine allows the pump modules to achieve high efficiency at full load as well as at part load.

In embodiments, each pump module comprises a control system provided with a communication interface for wired or wireless connection between the pump modules, wherein the control system is provided with a lead setting and a follower setting, wherein in said lead setting, the control system is configured to control, via said communication interface, at least one additional pump module having its control system set to the follower setting. In other words, the capability for the pump modules to co-act is a built-in feature of the control systems. Such embodiments are advantageous since no external control means is required to operate two or more pump modules together. The communication interface may use a wired connection such as a cable extending between two pump modules or a wireless connection using any known technology such as WIFI, Bluetooth, radio communication or the like.

In embodiments, each pump module further comprises a pressure relief valve at its liquid outlet, the pressure relief valve having a controllable relief pressure, and being connected to a buffer tank to divert surplus liquid thereto. In other words, a pressure relief valve is arranged in fluid communication with the liquid outlet and a buffer tank such as to divert liquid from the liquid outlet to the buffer tank when the liquid pressure at the liquid outlet is equal to or higher than the relief pressure. The relief pressure is controllable, for example pneumatically. The pneumatic pressure can be controlled, for example electrically controlled from the control system.

In embodiments, the control system of a first pump module, when in said lead setting, is configured to, in response to instructions from an operator, control the electric motor and/or the pressure relief valve of the first pump module and to control, via said communication interface and the control system of the at least one additional pump module, the electric motor and/or the pressure relief valve of the at least one additional pump module. Thus, the pressure relief valve of the at least one additional pump module is/are controlled electrically.

The pressure relief valve of the at least one additional pump module may alternatively be controlled pneumatically by providing a pressurized air connection/conduit between (the (pneumatic control of) the pressure relief valve of the first pump module and the pressure relief valve of the at least one additional pump module. In such embodiments, the pressure relief valve of the first pump module is controlled electrically, whereas the pressure relief valve of the at least one additional pump module is/are controlled pneumatically/mechanically, i.e. not electrically.

The instructions may comprise a target outgoing liquid pressure and/or a target pump speed and/or target liquid flow. The control system of the first pump module may be configured to control the electric motors (of the first pump module and of the at least one additional pump module) and/or the pressure relief valves (of the first pump module and of the at least one additional pump module) to achieve the target outgoing liquid pressure and/or said target pump speed and/or said target liquid flow. It is understood that target pump speed is closely correlated to the resulting liquid flow, i.e. an instruction regarding pump speed is indicative of the liquid flow.

In embodiments, the control system comprises a control panel provided with a user interface and/or wherein the pumping assembly comprises at least one wireless remote-control unit configured to communicate with at least one of the control systems. The control panel may be a touch-sensitive display and/or may comprise (physical) control buttons. The wireless remote-control unit may communicate with the control panel via radio signals, In embodiments, the control system is adapted to selectively activate the lead setting or the follower setting in response to instructions received from said control panel and/or from said at least one wireless remote-control unit.

In embodiments, the pumping assembly further comprises a connecting cable having first and second ends of different configuration, wherein the communication interface of the control system of each pump module is configured for wired communication by means of said connecting cable, wherein the control system is adapted to activate the lead setting in response to a first end of the connecting cable being connected to its communication interface and to activate the follower setting in response to a second end of the connecting cable being connected to its communication interface. The first and second ends of the connecting cable may for example differ in that at the first end, two of the pins are bridged, whereas at the other end they are not bridged. Such embodiments are advantageous since the lead and follower settings are automatically set, thus situations where for example two pump modules are accidentally both set to lead are avoided.

In embodiments, the control system is adapted receive said instructions comprising a target outgoing liquid pressure and/or a target pump speed and/or target liquid flow from the control panel and/or from said at least one wireless remote-control unit. For example, the target pump speed may be set at the control panel at the (lead) pump module, and the target outgoing liquid pressure may be set from the wireless remote-control unit.

In embodiments, at least one pump module is provided with a battery set connected to, and dimensioned to drive, its electric motor, and a charger configured to charge the battery set. The battery set may be dimensioned to drive the electric motor in the sense that it has sufficient current output capability to drive the electric motor. The battery set may be described as dimensioned to intermittently drive the electric motor in the sense that it has sufficient energy storage capability to drive the motor for a certain time. The battery set may for example have a capacity of at least 100 kWh. Such embodiments are advantageous since they allow the pump modules to be operated at working sites where electrical power is temporarily missing, or where electrical power is available but not at sufficiently larger current/power to drive the electric motor at full power.

In embodiments, the charger has a lower power rating than the maximum power rating of the electric motor. Such embodiments are advantageous since they allow the pump assembly to operate off a power source of lower capacity than the power rating of the electric motors, so-called "peak shaving". The charger may for example be configured to be driven of a 3-phase 125 A or a 3-phase 63 A power source/supply (or less) although the electric motors would require for example a 3-phase 250 A power source if driven directly from the power source. The charger is advantageously configured to charge the battery set continuously.

The battery set and the charger may be arranged on the same chassis/in the same enclosure as the other parts of the pump module (electric motor, pump etc.). Alternatively, battery set and the charger of one or more or each of the pump modules can be arranged on a separate chassis/enclosure. This further improves modularity.

The features of the embodiments described above are combinable in any practically realizable way to form embodiments having combinations of these features.

BRIEF DESCRIPTION OF THE DRAWINGS

Above discussed and other aspects of the present invention will now be described in more detail using the appended drawings, which show presently preferred embodiments of the invention, wherein.

DETAILED DESCRIPTION

Figure 1:
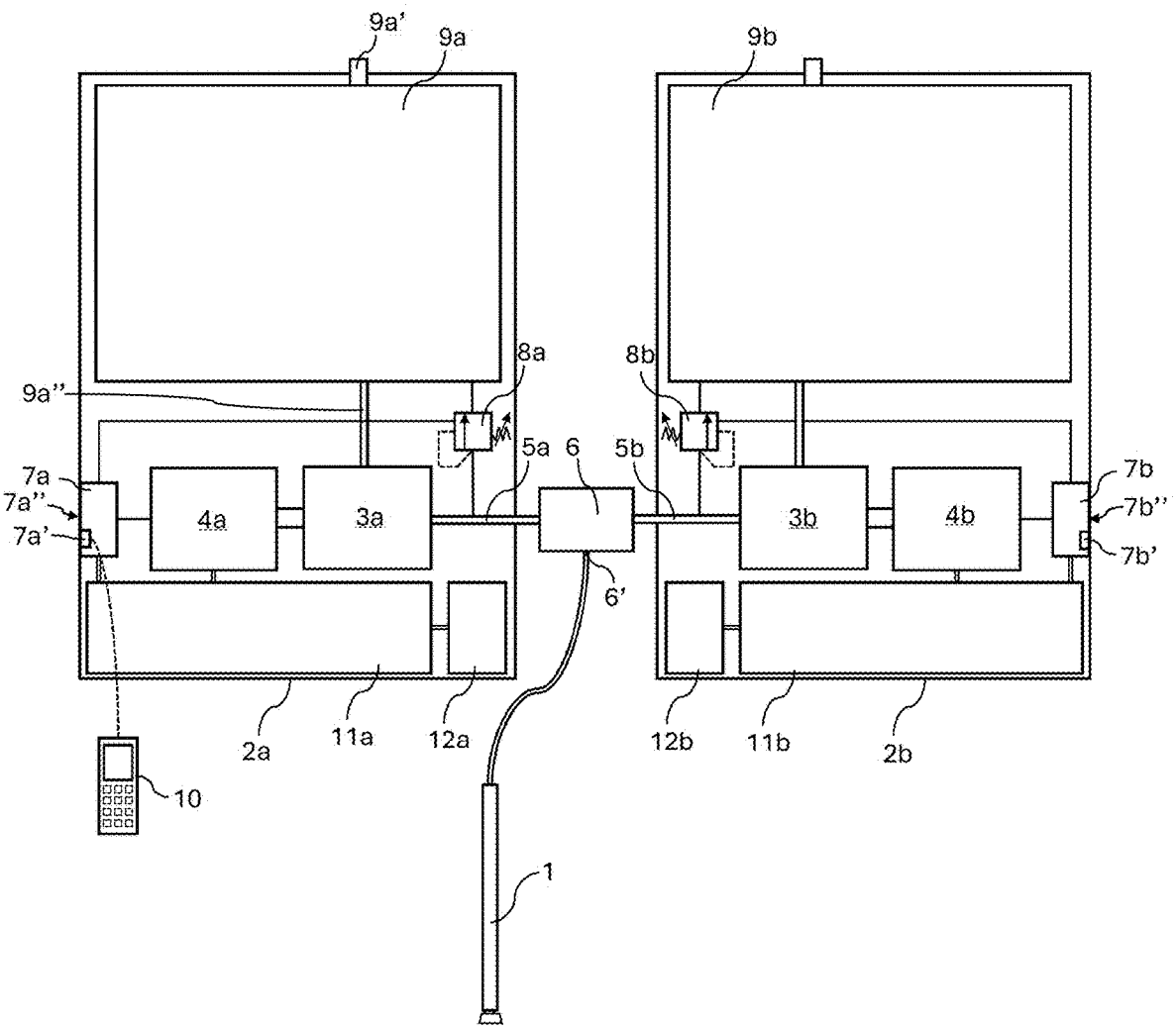
FIG. 1 shows a schematic top-view illustration of an embodiment of a pumping assembly according to the invention connected to a liquid propelled hammer.

FIG. 1 shows a schematic illustration of an embodiment of a pumping assembly according to the invention connected to a liquid propelled hammer 1 (which is not part of the pumping assembly but only shown for illustrative purposes). The pumping assembly comprises two pump modules 2*a*, 2*b*, each comprising a liquid pump 3*a*, 3*b*, an electric motor 4*a*, 4*b* connected to drive the liquid pump and a liquid outlet 5*a*, 5*b* for providing pressurized liquid from the respective liquid pump. An outlet manifold 6 connects the liquid outlets 5*a*, 5*b* of the two pump modules in parallel to provide a common liquid outlet 6' which is connected to the liquid propelled drill 1.

Each pump module 2*a*, 2*b* further comprises a buffer tank 9*a*, 9*b* having an inlet (9*a*' for example) connectable to a source of liquid and an outlet (9*a*" for example) connected to the respective liquid pump 3*a*, 3*b*. Each pump module further comprises a pressure relief valve 8*a*, 8*b* at its liquid outlet 5*a*, 5*b*, the pressure relief valve having a controllable relief pressure, and being connected to the buffer tank 9*a*, 9*b* to divert liquid thereto when the relief pressure is reached.

Each pump module 2*a*, 2*b* is also provided with a battery set 11*a*, 11*b* connected to, and dimensioned to intermittently drive, the respective electric motor 4*a*, 4*b*, and a charger 12*a*, 12*b* configured to charge the respective battery set. The charger 12*a*, 12*b* has a lower power rating than the maximum power rating of the electric motor 4*a*, 4*b*. The charger 12*a*, 12*b* is configured to be driven of a 3-phase 63 A power supply or less. Each battery set 11*a*, 11*b* has a capacity of at least 100 kWh.

The pump modules 2*a*, 2*b* are configured to provide a maximum liquid pressure of 120-240 bar. The pump modules 2*a*, 2*b* are each configured to provide a liquid flow of 200-600 l/min, thus resulting in a combined liquid flow of 400-1200 l/min.

Each pump module comprises an electronic control system 7*a*, 7*b* provided with a wireless (radio) communication interface 7*a*', 7*b*' for wireless connection between the pump modules. The control systems 7*a*, 7*b* can be set selectively to either a lead setting or a follower setting. For example, the control system 7*a* of the first pump module can be set to the lead setting such that the control system 7*a* controls, via the communication interface, the second pump module 7*b* having its control system 7*b*' set to the follower setting.

Figure 2:
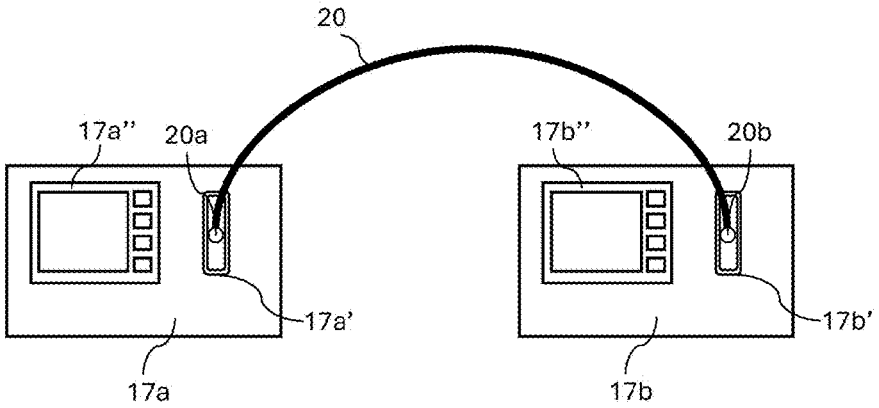
FIG. 2 shows a schematic front view of parts of another embodiment of a pumping assembly according to the invention.

The control systems 7*a*, 7*b* are each provided with a control panel 7*a*", 7*b*" (not seen, but is of the same type as shown in FIG. 2 and described below with reference thereto) provided with a user interface. The first pump module 2*a* is furthermore provided with a wireless remote-control unit 10 configured to communicate with its control system 7*a*. The second pump module can also be provided with such a wireless remote-control unit, but this is not shown in the figure, and is also not used assuming that the control system of the first pump module is set to lead setting.

The control system 7*a* of the first pump module 2*a*, being in the lead setting, is configured to, in response to instructions from an operator, control the electric motor 4*a* and the pressure relief valve 8*a* of the first pump module and to control, via the communication interface 7*a*', the electric motor 4*b* and the pressure relief valve 8*b* of the second pump module 2*b*.

The operator provides the instructions using the control panel 7*a*" and the remote-control unit 10. More specifically, a target pump speed is set using the control panel 7*a*" and a target outgoing liquid pressure is set using the remote-control unit 10.

The operator sets the first pump module 2*a* to the lead setting using the control panel 7*a*" and the second pump module 2*b* to the follower setting using its control panel 7*b*".

FIG. 2 shows parts of another embodiment of a pumping assembly according to the invention. In the figure, only the control systems 17*a*, 17*b* of first and second pump modules are shown, which control systems differ from those described above with reference to FIG. 1. The control systems 17*a*, 17*b* each comprise a communication interface 17*a*", 17*b*" configured for wired communication with each other via a connecting cable 20. The cable is connected to the first communication interface 17*a*" with a first end 20*a* thereof and to the second communication interface 17*b*" of the control system with a second end 20*b* thereof. The control systems 17*a*, 17*b* are adapted to automatically activate the lead setting in response to a first end of the connecting cable being connected to its communication interface and to automatically activate the follower setting in response to a second end of the being connected to its communication interface. Thus, the first control system 17*a* is set to the lead setting and the second control system 17*b* is set to the follower setting. This is achieved by means of the first and second ends 20*a*, 20*b* of the connecting cable having a differing configuration (at the first end 20*a*, two of the pins are bridged, whereas at the other end they are not bridged). Just like in the embodiment in FIG. 1, the control systems are each provided with a control panel 17*a*", 17*b*" provided with a display and control buttons for inputting the target pump speed (and optionally other inputs).

Apart from the different control systems, this embodiment of a pumping assembly corresponds exactly to that shown and described above with reference to FIG. 1 and the description thereof thus applies also to this embodiment. In other embodiments, which may also be described with reference to FIG. 2, the cable 20 comprises not only electrical cables but also a pressurized air conduit (or such a conduit extends between the modules without being part of the cable). The pressurized air conduit connects the pressure relief valve of the second pump module to the pressure relief valve of the first pump module. Thus, such embodiments differ from the embodiment in FIG. 2 in that the pressure relief valve of the second pump module is mechanically/pneumatically controlled rather than electrically controlled.

The description above and the appended drawings are to be considered as non-limiting examples of the invention. The person skilled in the art realizes that several changes and modifications may be made within the scope of the invention. For example, the number of pump modules can be more than two. Furthermore, the pump modules do not necessarily need to be provided with a respective battery set and charger.

The invention claimed is:

1. A system, comprising:

a liquid propelled drill or hammer;

a pumping assembly for providing pressurized liquid to the liquid propelled drill or hammer, the pumping assembly comprising:

at least two pump modules, each comprising:

at least one liquid pump;

at least one electric motor arranged to drive said at least one liquid pump;

a liquid outlet for providing pressurized liquid from the at least one liquid pump; and a control system provided with a communication interface for wired or wireless connection between the at least two pump modules, wherein each control system is provided with a lead setting and a follower setting, wherein the control system of a first pump module of the at least two pump modules, when in said lead setting, is configured to: control, via said communication interface, at least one other pump module of said at least two pump modules having its control system set to the follower setting, and control, in response to instructions from an operator, the electric motor of the first pump module and to control, via said communication interface, the electric motor of the at least one other pump module;

an outlet manifold connecting the liquid outlets of the at least two pump modules in parallel to provide a common liquid outlet for connection to said liquid propelled drill or hammer;

wherein said pump modules are each configured to provide a liquid flow of 200-600 l/min; and wherein at least one of (i) the control system of each pump module comprises at least one control panel provided with a user interface or (ii) the pumping assembly comprises at least one wireless remote-control unit configured to communicate with at least one of the control systems; and a connecting cable having first and second ends of different configuration, the first and second ends being of different configuration in that two pins are bridged at the first end, whereas at the second end corresponding pins are not bridged;

wherein the communication interface of the control system of each pump module of the at least two pump modules is configured for wired communication by means of said connecting cable; and wherein the control system of each pump module is adapted to activate the lead setting in response to the first end of the connecting cable being connected to its communication interface and to activate the follower setting in response to the second end of the connecting cable being connected to its communication interface.

2. The system according to claim 1, wherein each pump module further comprises a pressure relief valve at its liquid outlet, the pressure relief valve having a controllable relief pressure, and being connected to a buffer tank to divert surplus liquid thereto.

3. The system according to claim 2, wherein the control system of the first pump module, when in said lead setting, is further configured to, in response to instructions from an operator, control the pressure relief valve of the first pump module and to control, via said communication interface, the pressure relief valve of the at least one other pump module.

4. The system according to claim 3, wherein said instructions comprise at least one of a target outgoing liquid pressure or a target pump speed, and wherein said control system of the first pump module is configured to control at least one of the electric motors or the pressure relief valves to achieve at least one of said target outgoing liquid pressure or said target pump speed.

5. The system according to claim 4, wherein each control system is adapted to receive said instructions comprising at least one of the target outgoing liquid pressure or the target pump speed from at least one of said control panel or said at least one wireless remote-control unit.

6. The system according to claim 1, wherein each control system is adapted to selectively activate the lead setting or the follower setting in response to instructions received from at least one of said control panel or from said at least one wireless remote-control unit.

7. The system according to claim 1, wherein at least one pump module of the at least two pump modules is provided with a battery set connected to, and dimensioned to intermittently drive, its electric motor, and a charger configured to charge the battery set.

8. The system according to claim 7, wherein the charger has a lower power rating than a maximum power rating of the electric motor.

9. The system according to claim 7, wherein the charger is configured to be driven off a 3-phase 125 A power supply or less, such as a 3-phase 63 A power supply.

10. The system according to claim 7, wherein said battery set has a capacity of at least 100 kWh.

11. The system according to claim 1, wherein said pump modules are configured to provide a maximum liquid pressure of 120-240 bar.

* * * * *